US005619826A

United States Patent [19]

Wu

[11] Patent Number: 5,619,826

[45] Date of Patent: Apr. 15, 1997

[54] BATHROOM ASSEMBLY CONSTRUCTION

[76] Inventor: Wan-Kuei Wu, No. 38, Lane 187, Nan Ya Street, Hsinchu City, Taiwan

[21] Appl. No.: 572,030

[22] Filed: Dec. 14, 1995

[51] Int. Cl.[6] ..... E04H 1/12; E04B 1/00; A47K 3/16

[52] U.S. Cl. ..... 52/35; 52/79.5

[58] Field of Search ..... 52/79.1, 79.5, 52/34, 35

[56] References Cited

U.S. PATENT DOCUMENTS

| | | | |
|---|---|---|---|
| 4,993,201 | 2/1991 | Bunyard | 52/35 |
| 5,036,634 | 8/1991 | Lessard et al. | 52/79.1 |

FOREIGN PATENT DOCUMENTS

| | | | |
|---|---|---|---|
| 1018719 | 1/1977 | Canada | 52/79.1 |
| 260171 | 10/1989 | Japan | 52/79.1 |
| 290877 | 11/1989 | Japan | 52/79.1 |
| 406117123 | 4/1994 | Japan | 52/34 |

*Primary Examiner*—Carl D. Friedman
*Assistant Examiner*—Timothy B. Kang
*Attorney, Agent, or Firm*—Thomas R. Vigil

[57] ABSTRACT

An improved bathroom assembly construction includes a base, a plurality of corner posts, plates and partition strips, a roof, a plurality of corner caps and a plurality of securing means. Both the base and the roof are provided with corner slots, mounting slots and indentations for mounting respectively the corner posts, plates and partition strips to eliminate use of screw bolts. The corner posts may extend from the corners of the roof with the corner caps fitted thereon and may be secured firmly by means of the securing means. A gap is formed between two adjacent plates and is of a size matching that of a gap formed between two adjacent tiles so that, after tiles are arranged on the plates each of which has a width equivalent to a total width of a plurality of tiles, the bathroom assembly may look very neat.

4 Claims, 7 Drawing Sheets

BATHROOM ASSEMBLY CONSTRUCTION

BACKGROUND OF THE INVENTION (a) Field of the Invention

The present invention relates generally to an improved bathroom assembly, and more particularly to an improved bathroom assembly which may be conveniently assembled and which allows replacement of the parts thereof from within.

(b) Description of the Prior Art

Conventional bathroom assembles generally comprise a plurality of suitably sized plates mounted on a base and covered by a roof. These components are however fastened in place by means of screw bolts secured in corresponding securing holes on the outer sides thereof, and assembling a conventional bathroom assembly is therefore a very complicated and labor-consumptive job. Moreover, after the bathroom assembly of the conventional type is properly assembled and installed at a suitable place, it is often necessary to erect a decorative wall of bricks or wood to cover up the unseemly outer surface of the bathroom assembly. As a consequence, when any one of the plates is damaged and needs replacement, as the screw bolts are located on the outer side of the plate, it is necessary to tear down the decorative wall before replacement may be proceeded, which is indeed very inconvenient and costly.

SUMMARY OF THE INVENTION

According to a first aspect of the invention, the improved bathroom assembly comprises a base, a roof, a plurality of plates, corner posts and partition strips, in which the corner posts may be secured by pins on the base and have the top end portions thereof protruding from the corners of the roof so that corner caps and securing means may be disposed on the roof to achieve stable installation of the bathroom assembly.

According to a second aspect of the invention, the improved bathroom assembly consists of easily removable securing means and corner caps so that the roof may be lifted up to facilitate replacement of the plates, eliminating the drawbacks in the prior art.

According to a third aspect of the invention, the improved bathroom assembly is consisted of a plurality of plates in which a gap of a suitable width is formed between two adjacent plates and each plate is configured to have a width matching a total width of a plurality of tiles to facilitate tidy arrangement of tiles thereon.

BRIEF DESCRIPTION OF THE DRAWINGS

The foregoing and other features and advantages of the present invention will be more clearly understood from the following detailed description and the accompanying drawings, in which, FIG. 1 a perspective view of a base of a preferred embodiment of the bathroom assembly of the invention.

DETAILED DESCRIPTION OF THE PREFERRED EMBODIMENT

Figure 1:
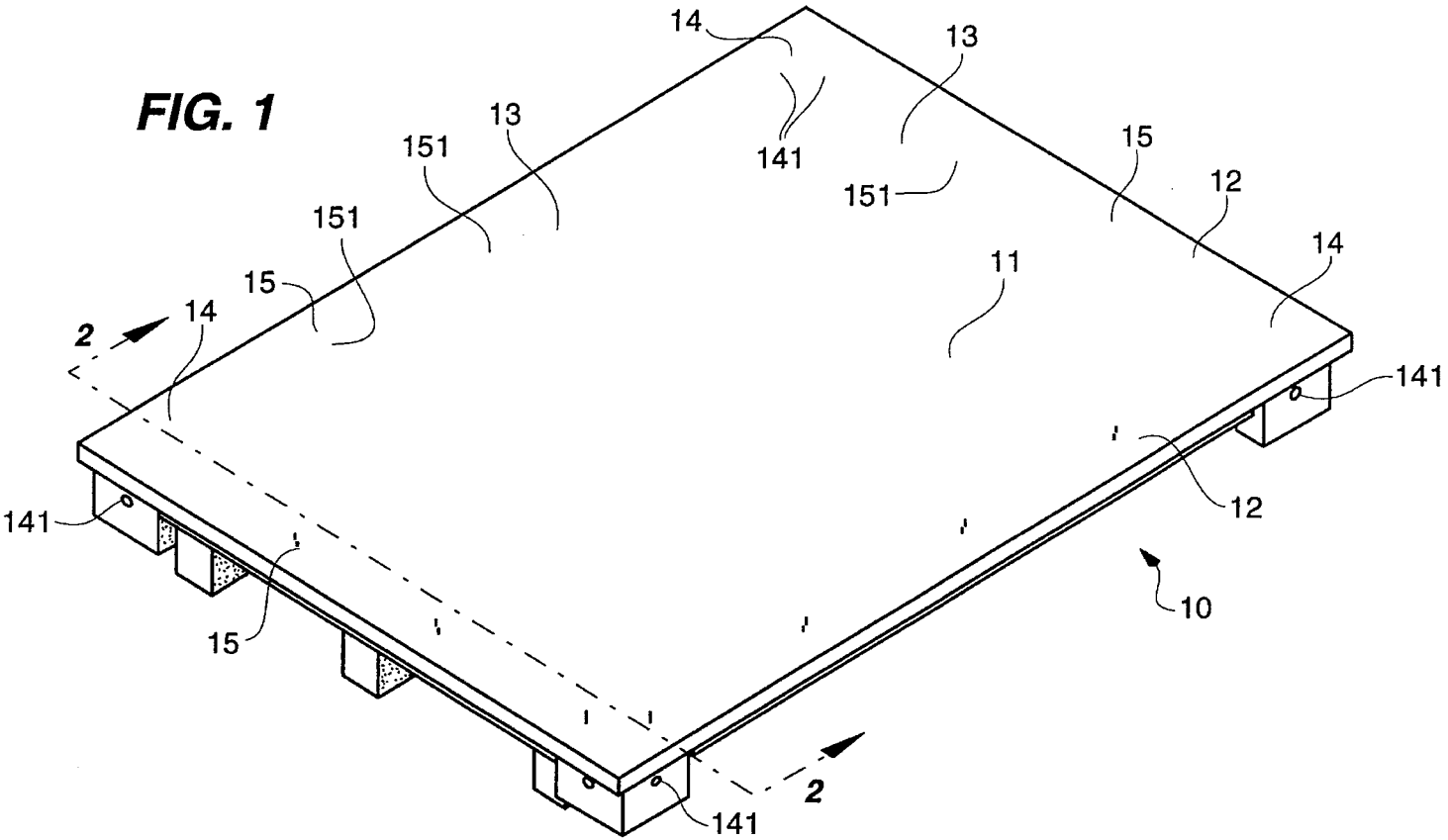

With reference to the drawings, a preferred embodiment of the improved bathroom assembly according to the invention essentially comprises a base 10, a plurality of corner posts 20, a plurality of plates 30, a plurality of partition strips 40, a roof 50, a plurality of corner caps 60 and a plurality of securing means 70.

Figure 2:
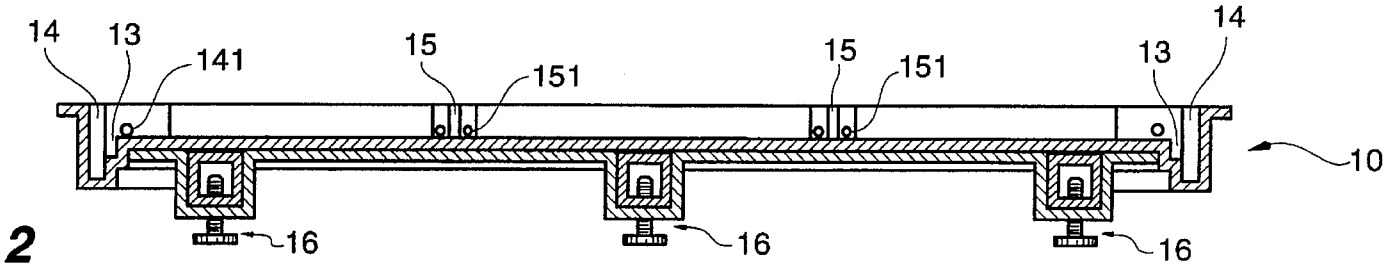
FIG. 2 is a sectional schematic view of FIG. 1, taken along line A—A.
Figure 3:
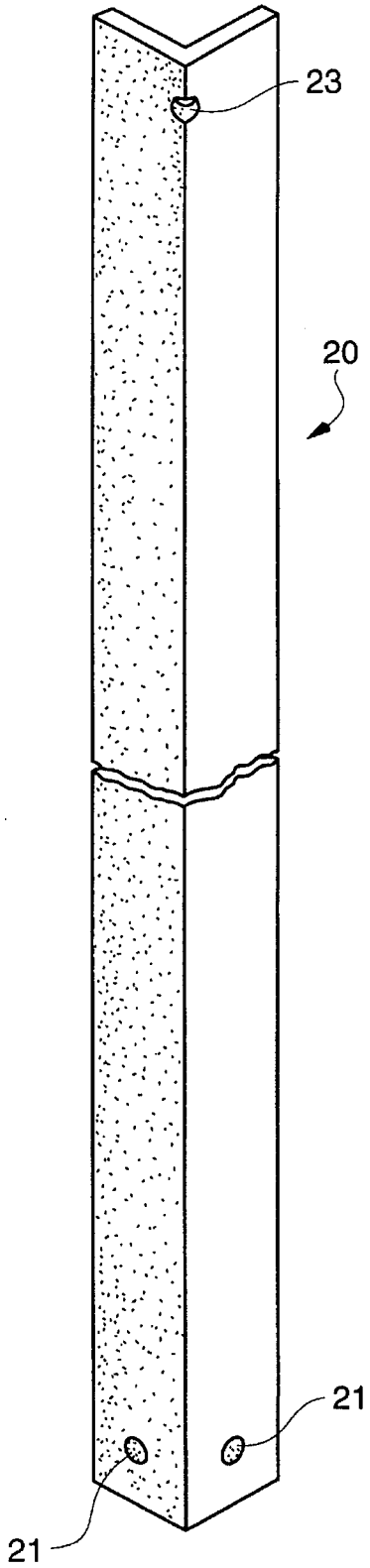
FIG. 3 is a perspective view of a corner post of the bathroom assembly of the invention.

With reference to FIGS. 1 and 2, the base 10 is a quadrilateral pre-cast plate having a peripheral level flange 12 of a suitable width slightly raised above a bottom plate 11 thereof. Intermediate the level flange 12 and the bottom plate 11 are a plurality of mounting grooves 13 at a position slightly lower than that of the bottom plate 11. Aside from having four corner slots 14, the level flange 12 is also provided with a plurality of indentations 15 spaced apart at determined distances in the four inner side walls thereof. The indentations 15 extend to the bottom of the mounting grooves 13. The corner slots 14 extend farther below into the base 10 than the mounting grooves 13 and are respectively provided with a through hole 141 in their respective outer side walls at a suitable position. Each indentation 15 also has a plurality of mounting holes 151 in its side wall. Besides, the base 10 is provided with a plurality of adjustable legs 16 for adjusting the level of the bathroom assembly of the invention.

As shown in FIG. 2, the corner posts 20 are posts of a suitable length. Each corner post 20 has an angular cross section and may be insertably mounted in the corresponding corner slot 14. Besides, each corner post 20 is provided with a plurality of post holes 21 for matching the through holes 141 of the corner slot 14, so that pins 22 may be passed through the post holes 21 and the through holes 141 to secure the corner post 20 in the corner slot 14 of the base 10. Each corner post 20 is further provided with an internal positioning hole 23 in the angular bent near the upper end thereof.

Figure 5:
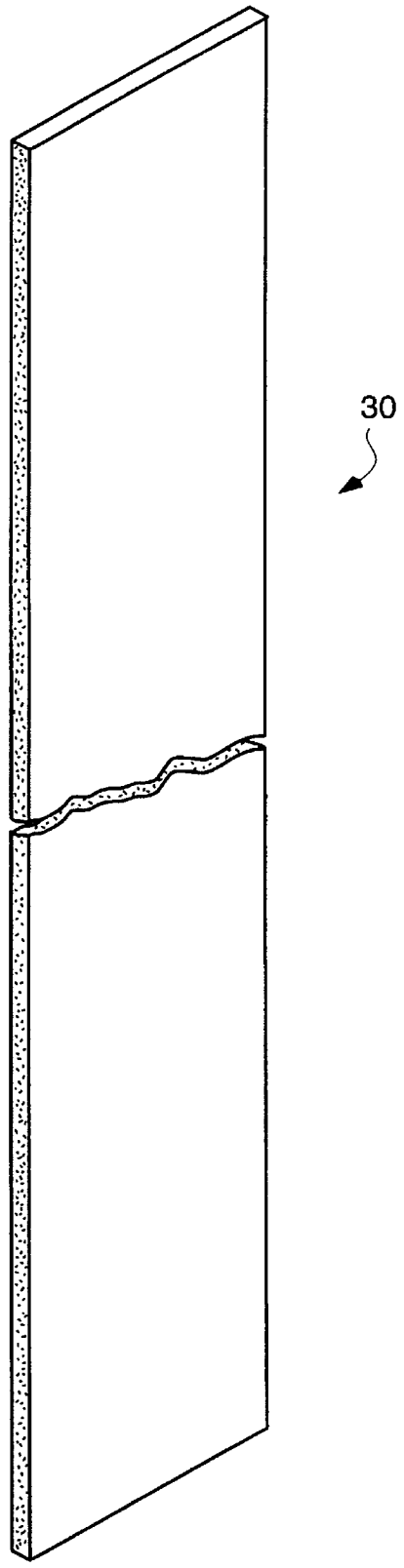
FIG. 5 is perspective view of a plate of the bathroom assembly of the invention.
Figure 10:
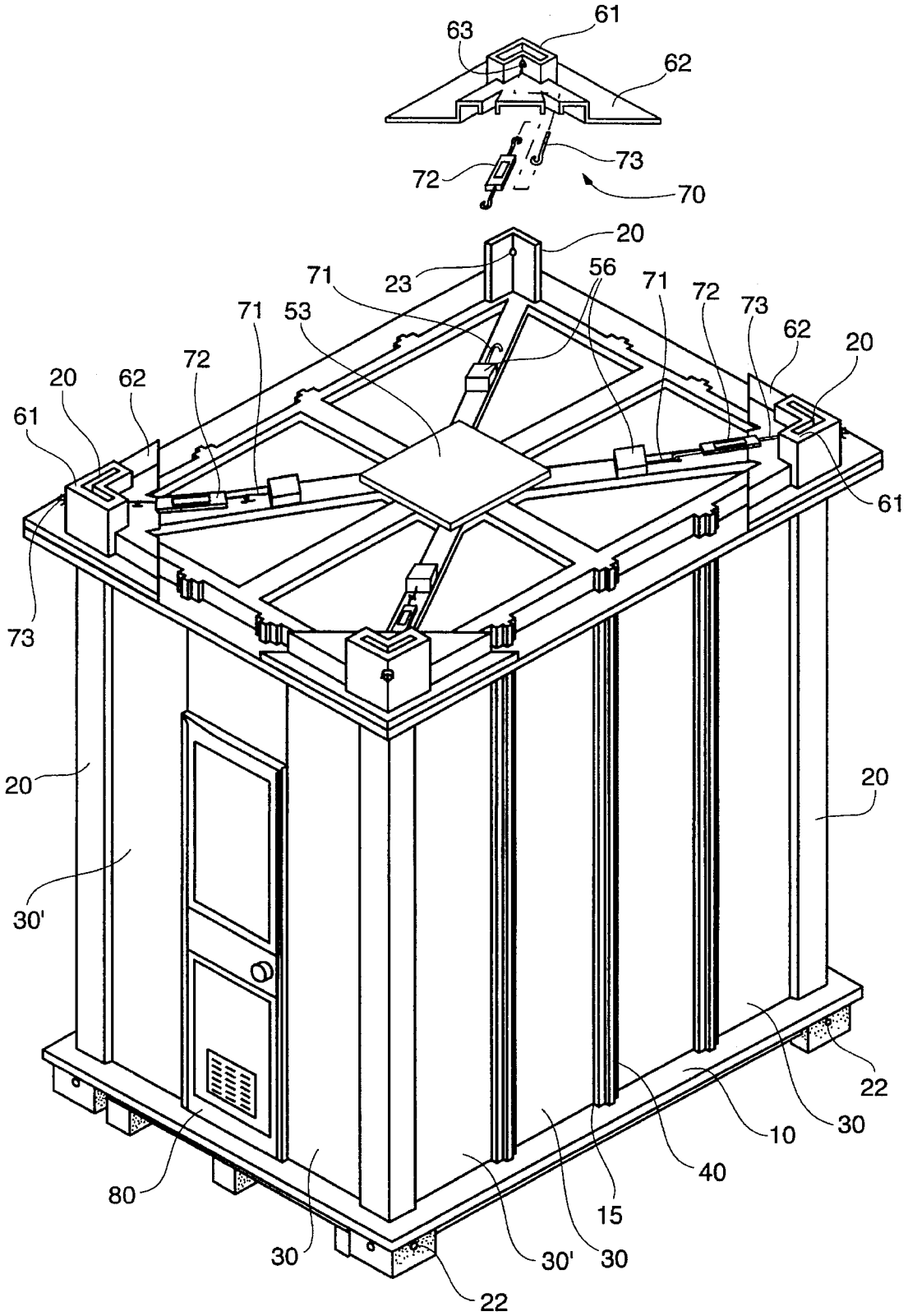
FIG. 10 is a partially exploded, elevation view of the bathroom assembly of the invention.

With reference to FIG. 5, the plates 30 are rectangular plates of a suitable size. Two plates 30 may be mounted substantially side by side into the corresponding mounting grooves 13 in each side of the quadrilateral base 10 such that a gap 31 of a suitable size may be formed between the two plates 30 at a middle portion of the corresponding indentation 15. A plate 30' adjacent to one of the corners of the base (i.e., the rightmost plate 30 on each side of the of the bathroom assembly when viewed from inside) has an outer rim extending sideways to form an extended portion 32 of a size approximately the thickness of the plate 30 itself, so that the plate 30' may not only lie close against a first side wall 24 of the adjacent corner post 20 but also touches against a second side wall 25 of the adjacent corner post 20 by means of the outer rim of the extended portion 32 thereof. Additionally, the extended portion 32 may be joined to an outer rim of another plate 30 which lies close against the second side wall 25 of the corner post 20. In one of the mounting grooves 13 in one side of the base 10 will not be mounted a plate 30 so that a conventional bathroom door 80 may be installed at that side of the base 10, as shown in FIG. 10.

Figure 4:
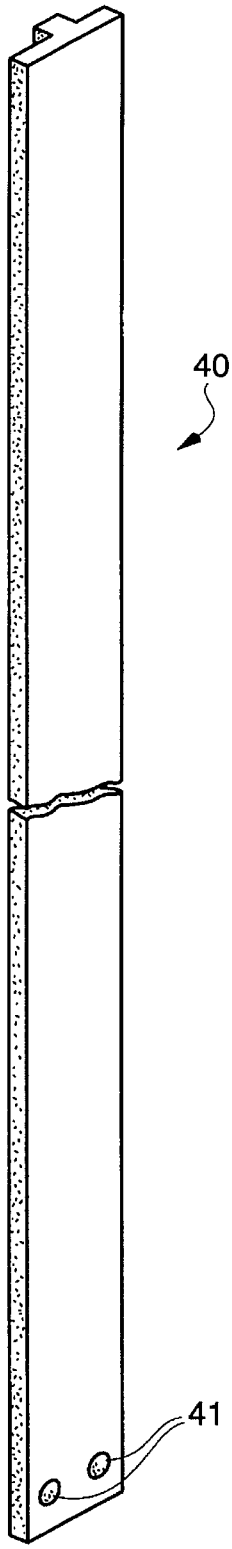
FIG. 4 is a perspective view of a partition strip of the bathroom assembly of the invention.
Figure 9:
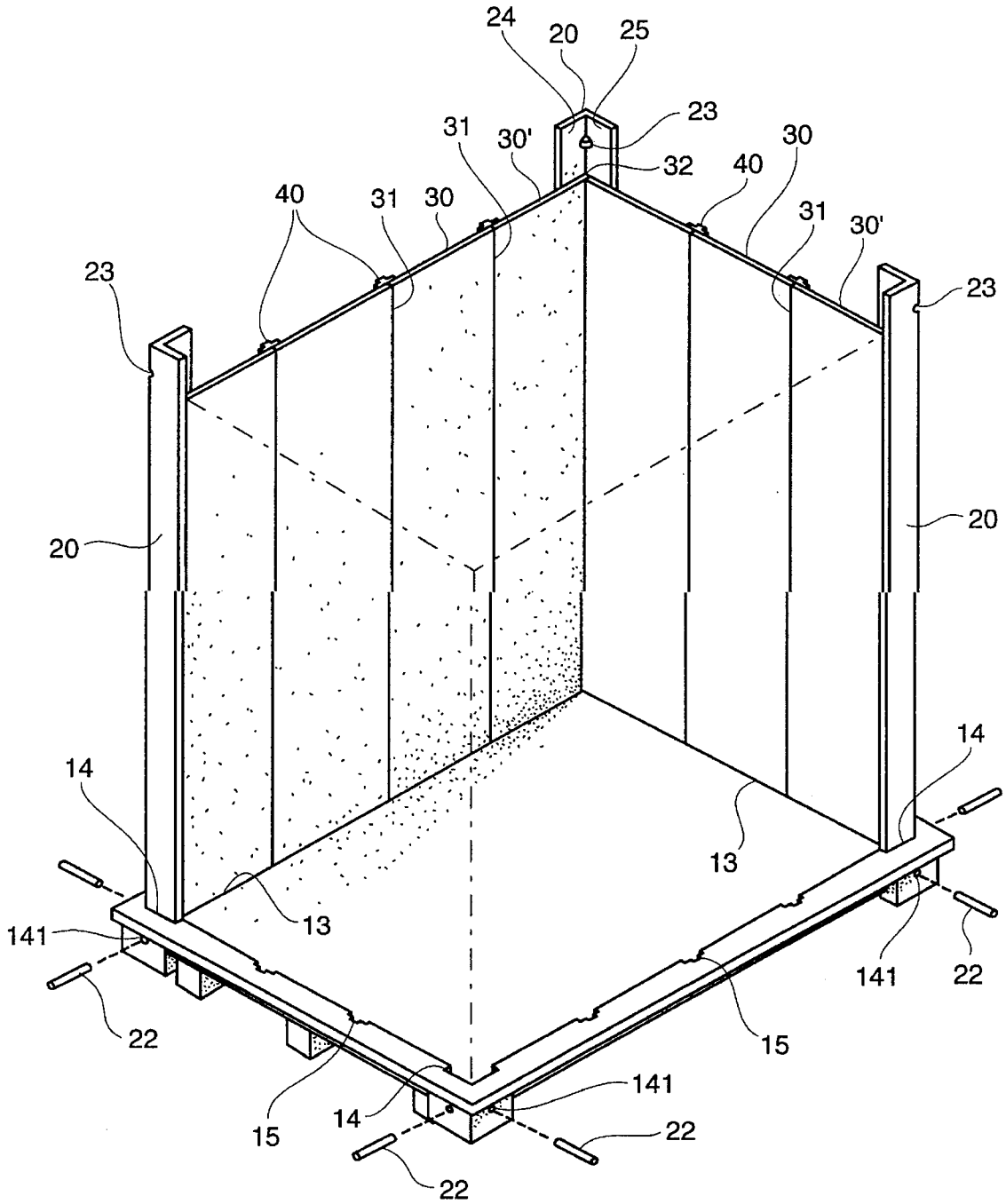
FIG. 9 is a perspective schematic view of the bathroom assembly of the invention without the roof.

As shown in FIG. 4, the partition strips 40 are strip-like plates having a cross section matching the shape of the indentation 15 of the base 10. Aside from having a length equivalent to that of the plate 30, each partition strip 40 is provided with a plurality of holes 41 in its lower end portion for matching the mounting holes 151 of each indentation 50, so that pins (not shown) may be inserted into the mounting holes 151 and the holes 41 to secure the partition strip 40 to the base 10 as an integral whole, as shown in FIG. 9.

Figure 6:
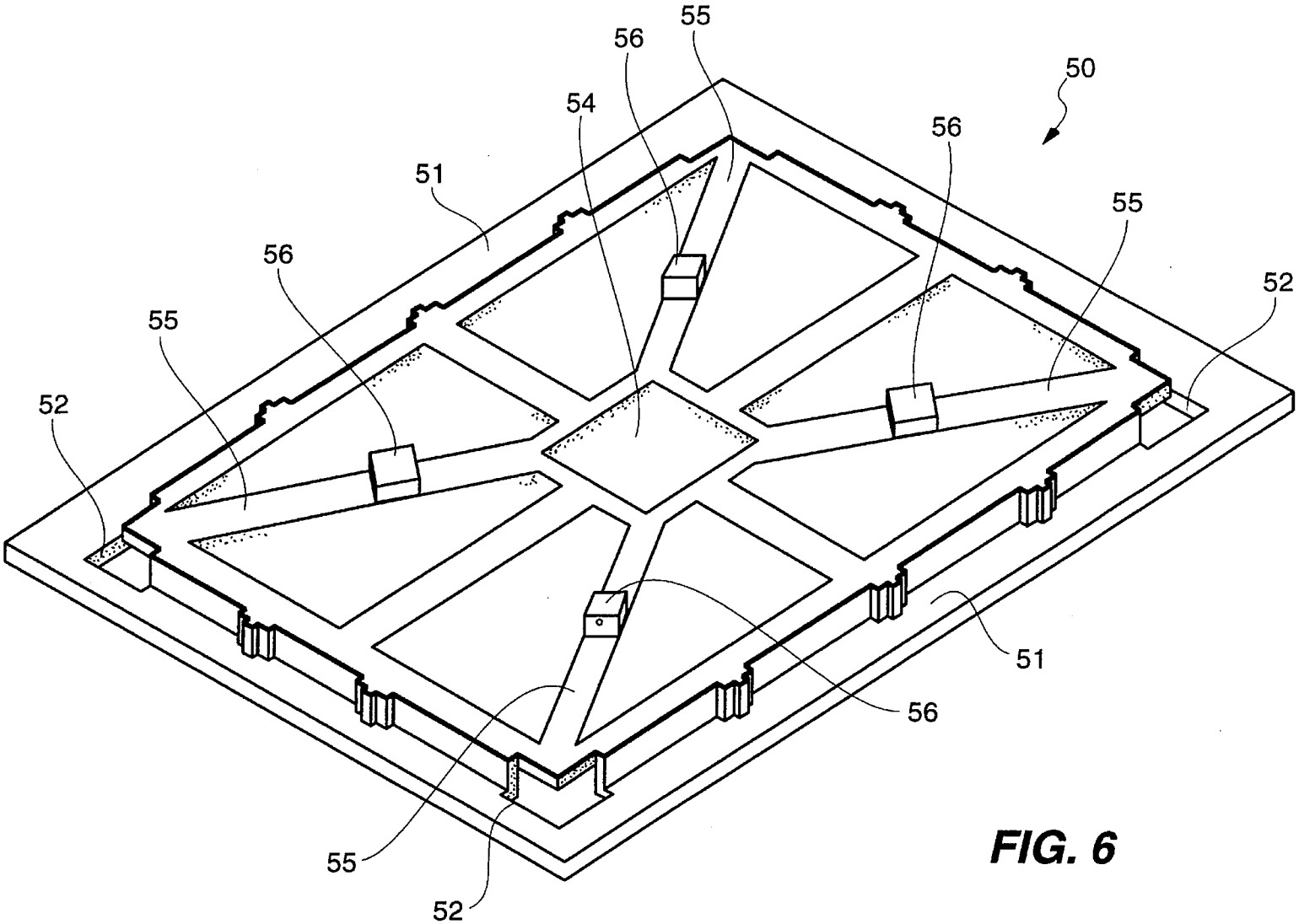
FIG. 6 is a perspective view of a roof of the bathroom assembly of the invention.
Figure 8:
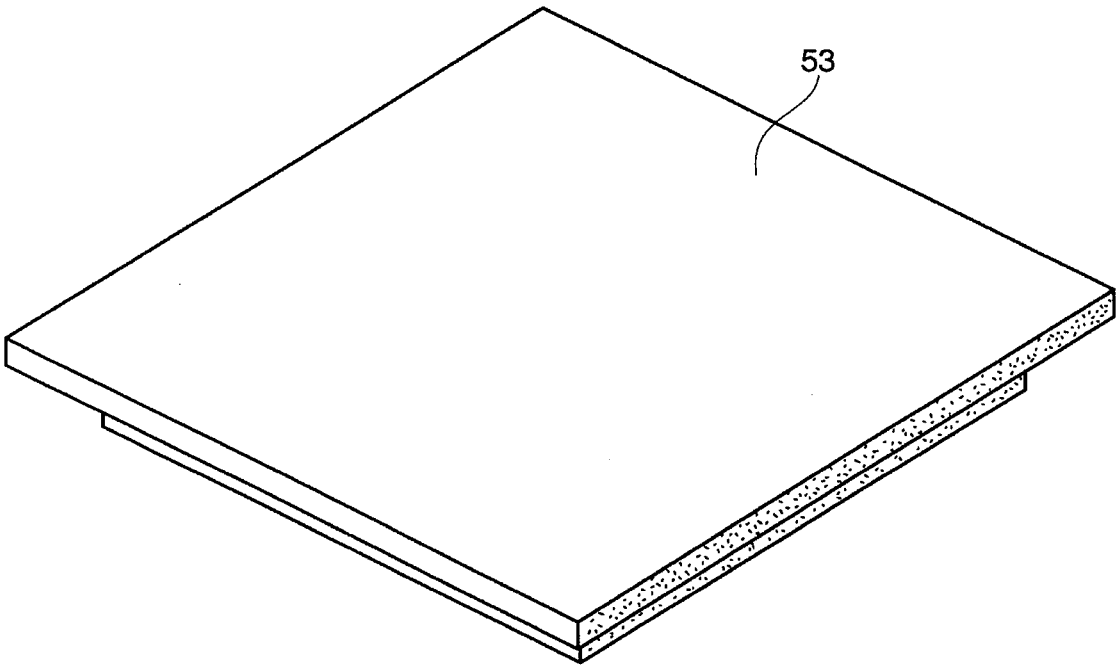

With reference to FIG. 6, the roof 50 is a pre-cast plate of a construction and size substantially the same as the base 10; that is, the roof 50 has not only a peripheral level flange 51 but also mounting grooves for receiving top portions of the plates 30 and indentations for receiving top portions of the partition strips 40 (FIG. 6 showing only the outer view of the mounting grooves and the indentations of the roof 5). In addition, the level flange 51 of the roof 50 is configured to have four corner slots 52 which, unlike the corner slots 14 of the base 10, are hollow ones so that the top ends of the corner posts 20 may penetrate therethrough to be projected therefrom. Besides, the roof 50 is provided with an inspection through hole 54 in a central portion thereof, which may be covered by an inspection cover 53 (as shown in FIG. 8). A plurality of reinforcing ribs 55 extend from the inspection through hole 54 to the four corners of the roof 50, and an anchor seat 56 is disposed on each reinforcing rib 55 at a suitable position.

Figure 7:
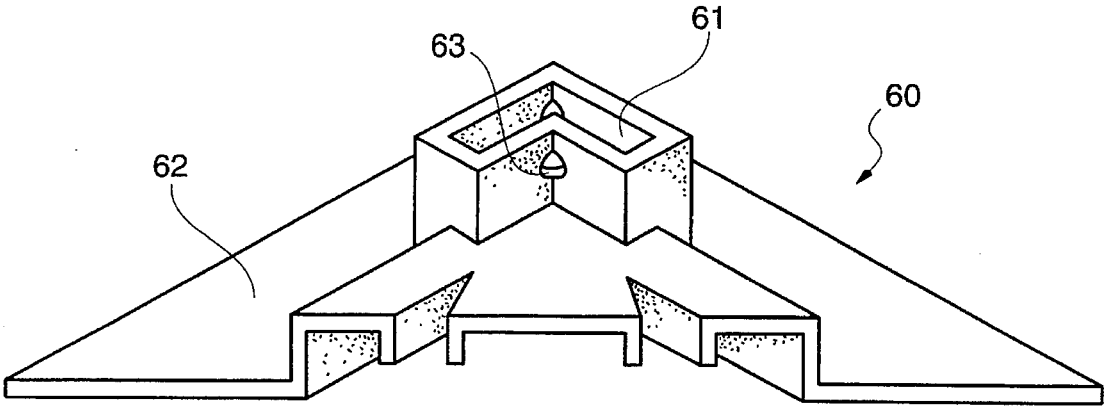
FIG. 7 is a perspective view of a corner cap of the bathroom assembly of the invention FIG. 8 a perspective view of an inspection cover for the roof shown in FIG. 6.

Referring to FIG. 7, each of the corner caps 60 consists of a bottom plate 62 provided with a vertically oriented right-angled through hole 61 at a suitable position. The contour of each corner cap 60 matches that of the corners of the roof 50 so that the bottom plate 62 of the corner cap 60 may fit tightly onto the corresponding corner of the roof 50 after the corresponding corner post 20 is fitted with its upper end through the corner slot 52 of the roof and the right-angled through hole 61 of each corner cap 60. The corner cap 60 is further provided with an external positioning hole 63 at a suitable position of its bend for matching the internal positioning hole 23 of the corresponding corner post 20.

With reference to FIG. 10, each securing means 70 includes a first securing element 71, a second securing element 72 and a third securing element 73. The first securing element 71 has one end thereof screwably secured to the corresponding anchor seat 56 while the other end thereof hooking a first hook of the second securing element 72. Likewise, the third securing element 73 has one end thereof screwably secured to both the external positioning hole 63 and the internal positioning hole 23 while the other end thereof hooking a second hook of the second securing element 72. After the securing elements 72 have been positioned in place, the gaps 31 between adjacent plates 30 may be filled with a sealing agent to complete the bathroom assembly.

In order that sanitary installations such as the sink and the toilet may be installed within the bathroom assembly according to the invention, suitable through holes or openings (not shown) may be formed at proper positions of the side walls of the bathroom assembly to allow passage of pipelines.

If any one of the plates 30 happens to wear or be damaged and requires replacement, it is only necessary to take down the securing means 70 via the inspection through hole 54. In other words, the third securing elements 73 are firstly screwed loose from both the external positioning holes 63 of the corner caps 60 and the internal positioning holes 23 of the corner posts 20 so that the corner caps 60 may be removed from the corner posts 20. The roof 50 is then pushed upwardly so that its mounting grooves may be separated from the top end portions of the plates 30. The damaged plate 30 may then be removed from the corresponding mounting groove 13 of the base 10 and replaced by a new one.

Since the replacement of the plates 30 may be proceeded from within of the bathroom assembly of the invention, it will not be necessary to tear down a decorative wall (not shown) erected outside the bathroom assembly as in the prior art, which is indeed very convenient and cost-economical.

Figure 11:
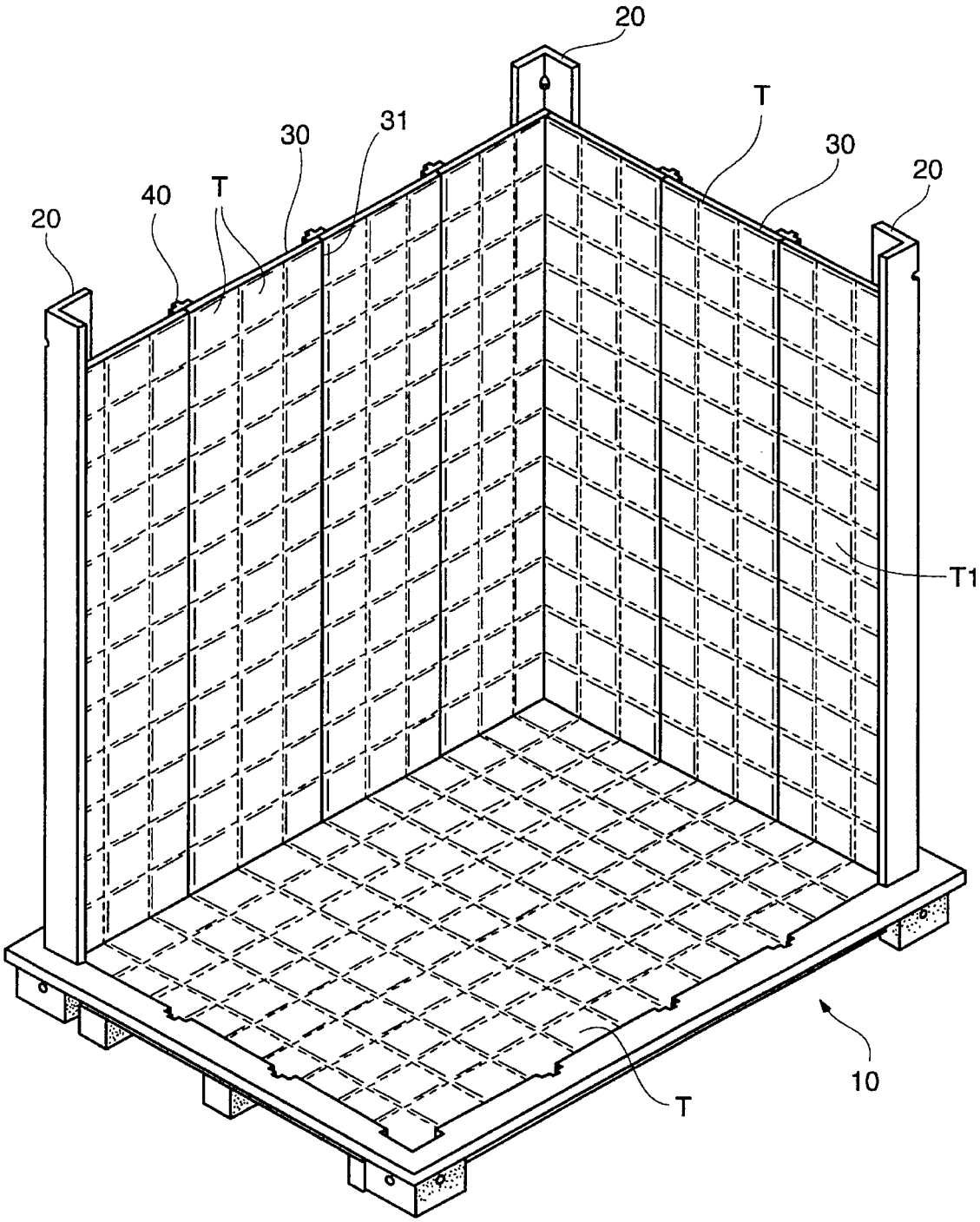
FIG. 11 schematic view of the bathroom assembly of the invention with the tiles covering the side walls and the base.

In addition, the width of the plates 30 according to the invention is designed to be equivalent to the total width of a plurality of tiles, such as three tiles T juxtaposed in a row as in the example shown in FIG. 11. Besides, the width of the gap 31 between two adjacent plates 30 is also designed to be equivalent to that of a gap T1 between two adjacent tiles T. By means of this arrangement, after all the side walls of the bathroom assembly of the invention are properly covered with tiles T, the tiles T may look neat and tidy with flushing horizontal and vertical seams. The bottom plate 11 of the base 10 may also be covered with tiles T such that the horizontal and vertical seams match those of the tiles T on the side walls to accomplish a bathroom assembly with uniformly and neatly arranged tiles.

Although the base 10 and the roof 50 are configured to be quadrilateral in the above-described examples, they may also be modified to have any polygonal shapes. In other words, any polygonal base or roof provided with the above-described mounting grooves, corner slots and indentations for respectively mounting plates, corner posts and partition strips as well as the above-mentioned corner caps and the securing means to constitute a polygonal bathroom assembly according to the invention are considered to fall within the scope of the invention.

Other than the quadrilateral bathroom assembly illustrated above, the above-mentioned polygonal bathroom assembly is preferably a triangular or a hexagonal one.

In summary, the bathroom assembly of the invention not only is simple in construction and convenient in installation but also facilitates replacement of the plates and arrangement of the tiles on the side walls.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved bathroom assembly construction comprising:

a base formed of a polygonal pre-cast plate and having a peripheral level flange which has a width and is raised a small distance above a bottom plate of said base, a plurality of mounting grooves disposed in said base intermediate said level flange and said bottom plate at a position lower than that of said bottom plate, said level flange having corner slots and a plurality of indentations spaced apart at predetermined distances in a plurality of inner side walls of said level flange, said indentations extending to bottom sides of said mounting grooves, said corner slots extending farther below said mounting grooves into said base than said mounting grooves and each said level flange in the area of said corner slots being provided with, respectively, a through hole in a respective outer side wall thereof, said level flange in the area of each of said indentations further having a plurality of mounting holes in a side wall thereof;

a plurality of corner posts each having a length, each of said corner posts having an angular cross section and being insertably mounted in one of said corner slots of said base, said corner posts being provided, respectively, with a plurality of post holes for matching one of said through holes of one of said corner slots of said base so that pins may be passed through said post holes and through said through holes to secure said corner posts in said corner slots of said base, each of said corner posts further being provided with an internal positioning hole in an angular bend near an upper end thereof;

a plurality of plates of a rectangular shape, a plurality of tiles on each of said plates, a couple of said plates being mounted substantially side by side into one of said mounting grooves in each side of said polygonal base such that a gap may be formed between said couple of plates at a middle portion of the corresponding indentation, a plate adjacent to one of the corners of said base having an outer rim extending sideways to form an extended portion of a size approximately the thickness of said plate itself so that said plate may not only lie close against a first side wall of an adjacent corner post but also touches against a second side wall of said adjacent corner post by means of said outer rim of said extended portion thereof, said extended portion being further joined to an outer rim of another plate which lies close against said second side wall of said adjacent corner post, no plates being mounted in one of said mounting grooves in one specific side of said base so that a conventional bathroom door may be mounted therein instead;

a plurality of partition strips in the form of strip-like plates each having a cross section matching the shape of said indentations of said base, each of said partition plates having a length equivalent to that of said plurality of plates and being provided with a plurality of holes in a lower end portion thereof for matching said mounting holes of each of said indentations so that pins may be inserted into said mounting holes and into said plurality of holes to secure said partition strip to said base as an integral whole;

a roof in the form of a pre-cast plate of a construction substantially the same as that of said base, said roof being provided with a plurality of corners and a peripheral level flange, a plurality of mounting grooves for receiving top end portions of said plates, and a plurality of indentations for receiving top end portions of said partition strips, said level flange of said roof being configured to have hollow corner slots so that the top end portions of said corner posts may penetrate therethrough to be projected therefrom, said roof further having an inspection through hole in a central portion thereof, said inspection through hole being coverable by a removable inspection cover, a plurality of reinforcing ribs extending from said inspection through hole to said corners of said roof and an anchor seat being disposed on each of said reinforcing ribs a plurality of corner caps each comprising a bottom plate provided with a vertically oriented right-angled through hole, each of said corner caps being configured to have a contour matching that of said corners of said roof so that said bottom plate thereof fits tightly onto an adjacent corner of said roof after the corresponding corner post is fitted with its upper end through said corner slot of said roof and said right-angled through hole of each of said corner caps which are, respectively, provided with an external positioning hole at a bend thereof for matching said internal positioning hole of an adjacent corner post; and a plurality of securing means each of which comprises a first securing element, a second securing element and a third securing element, said first securing element having one end thereof screwably secured to the corresponding anchor seat while the other end thereof hooks with a first hook of said second securing element, said third securing element having one end thereof screwably secured to both of said external positioning holes of an adjacent corner cap and said internal positioning hole of an adjacent corner post while the other end thereof hooks with a second hook of said securing element having been positioned in place, said gap between said couple of plates may be filled with a sealing agent to accomplish a complete bathroom assembly.

2. An improved bathroom assembly construction as claimed in claim 1, wherein said base and said roof have a shape selected from the group consisting essentially of triangular, rectangular, pentagonal, and hexagonal.

3. An improved bathroom assembly construction as claimed in claim 1, wherein each of said plates has a width equivalent to a total width of a plurality of tiles arranged thereon; said gap between said couple of plates has a width equivalent to that between two adjacent tiles; and said base is covered with tiles of the same size so that all the tiles of the bathroom assembly look very neatly arranged.

4. An improved bathroom assembly construction as claimed in claim 1, wherein said base has adjustable legs for adjusting the level of the bathroom assembly.

* * * * *